US006844512B2

(12) United States Patent
Benda

(10) Patent No.: US 6,844,512 B2
(45) Date of Patent: Jan. 18, 2005

(54) CIRCUIT BREAKER LOCK-OUT ASSEMBLY

(75) Inventor: Steven J. Benda, Cokato, MN (US)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 10/472,257

(22) PCT Filed: Mar. 18, 2002

(86) PCT No.: PCT/US02/08084

§ 371 (c)(1),
(2), (4) Date: Apr. 12, 2004

(87) PCT Pub. No.: WO02/077901

PCT Pub. Date: Oct. 3, 2002

(65) Prior Publication Data

US 2004/0159530 A1 Aug. 19, 2004

Related U.S. Application Data

(60) Provisional application No. 60/277,497, filed on Mar. 21, 2001.

(51) Int. Cl.[7] ..... H01H 9/28

(52) U.S. Cl. ..... 200/43.14; 200/43.18; 200/43.19

(58) Field of Search ..... 200/11 G, 6 BB, 200/535, 559, 283, 401, 520, 43.01, 43.11, 43.14, 43.15, 43.16, 43.18, 43.19, 43.21

(56) References Cited

U.S. PATENT DOCUMENTS

| | | | | |
|---|---|---|---|---|
| 2,169,860 A | | 8/1939 | Von Hoorn | |
| 2,937,248 A | | 5/1960 | Michetti | |
| 2,978,613 A | | 4/1961 | Hein | |
| 3,109,899 A | | 11/1963 | Pastene | |
| 3,288,954 A | * | 11/1966 | Norden | 200/43.15 |
| 3,408,466 A | | 10/1968 | Palmer | |
| 3,629,529 A | * | 12/1971 | Dietz | 200/43.19 |
| 3,784,766 A | | 1/1974 | Johnson et al. | |
| 4,006,324 A | | 2/1977 | Leasher et al. | |
| 4,300,030 A | | 11/1981 | Dimarco et al. | |
| 4,359,615 A | * | 11/1982 | Meyerhoefer et al. | 200/43.07 |
| 4,733,029 A | | 3/1988 | Kobayashi et al. | |
| 5,148,910 A | | 9/1992 | Williams | |
| 5,256,838 A | * | 10/1993 | Benda | 200/43.15 |
| 5,270,503 A | | 12/1993 | Frye | |
| 5,290,979 A | * | 3/1994 | Grass | 200/43.19 |
| 5,300,740 A | | 4/1994 | Benda | 200/43.14 |
| 5,322,980 A | | 6/1994 | Benda | |
| 5,500,495 A | | 3/1996 | Benda et al. | |
| 5,593,020 A | | 1/1997 | Alexander | |
| 5,648,646 A | | 7/1997 | Flegel | |
| 5,732,815 A | | 3/1998 | Brouwer | |
| 5,772,007 A | | 6/1998 | Frye | |
| 5,794,760 A | | 8/1998 | Alexander | |
| 5,817,998 A | * | 10/1998 | Siebels et al. | 200/43.14 |
| 5,900,600 A | | 5/1999 | Alexander et al. | |
| 6,266,231 B1 | | 7/2001 | Donahue et al. | |
| 6,396,008 B1 | | 5/2002 | Maloney et al. | |
| 6,469,264 B2 | * | 10/2002 | Benda | 200/43.14 |
| 6,727,441 B2 | * | 4/2004 | Benda | 200/43.15 |

FOREIGN PATENT DOCUMENTS

| | | |
|---|---|---|
| JP | 5211024 | 8/1993 |

* cited by examiner

*Primary Examiner*—Michael Friedhofer
*Assistant Examiner*—Lisa Klaus
(74) *Attorney, Agent, or Firm*—Quarles & Brady LLP

(57) ABSTRACT

A circuit breaker lock-out assembly which is engageable with a circuit breaker includes a body having a top and a bottom joined by walls. The walls define a passageway extending from the body top to the body bottom. A button having one end extending into the body passageway through the body top is movable between a lock position and an unlock position. A pair of leaf springs are fixed to the button, and extend through the passageway. A nose extends from the body bottom, ant is engageable with the leaf springs. A pin extends from each of the leaf springs. Each pin is engageable with a hole formed in the circuit breaker walls adjacent the switch tongue, wherein slidable movement of the button toward at least one of the lock position and unlock position engages the leaf spring with the nose to move each pin relative to the hole.

10 Claims, 3 Drawing Sheets

CIRCUIT BREAKER LOCK-OUT ASSEMBLY

CROSS REFERENCE TO RELATED APPLICATIONS

This application claims priority of International Patent Application PCT/US02/08084, filed on Mar. 18, 2002 and U.S. Patent Application No. 60/277,497, filed on Mar. 21, 2001.

BACKGROUND OF THE INVENTION

The field of invention is switch lever lock-outs for locking switch levers in a desired position, and more particularly to switch lever lockouts which engage holes formed in switch cavity walls.

Switches are used in many applications to control the flow of electrical energy. The switches can be used to redirect electrical energy from one circuit to another, and can be used to stop the flow of electrical energy through a circuit. In both cases the circuits become de-energized, that is without a voltage.

One particular type of switch is a circuit breaker which cuts off the flow of electrical energy when the flow of electrical energy through the switch exceeds a predetermined value. Many of these circuit breakers include a switch tongue movable between an "On" position and an "Off" position. Walls adjacent the switch tongue between the "On" and "Off" positions define a switch tongue cavity. Opposing holes in the wall can receive pins to prevent movement of the switch tongue.

Maintenance personnel often use a circuit breaker to interrupt the flow of electrical energy through a, circuit when the circuit, or electrical components connected thereto, require maintenance. The circuit breaker, however, is often remote from the location requiring maintenance. Therefore, it is desirable to lock out the circuit breaker to prevent an individual from inadvertently energizing the circuit while maintenance is being performed.

A known circuit breaker lock-out disclosed in French Patent No. 2,424,619 shows leaf springs having pins which engage the inwardly opening holes of the switch tongue cavity walls. However, operation of the lock-out is difficult, and requires two hands to engage and disengage the lock-out from the circuit breaker. Therefore, a need exists for an effective, easy to use, circuit breaker lock-out assembly.

BRIEF SUMMARY OF THE INVENTION

The present invention provides a circuit breaker lockout assembly which is engageable with a circuit breaker. The assembly includes a body having a top and a bottom joined by walls. The walls define a passageway extending from the body top to the body bottom A button having one end extending into the body passageway through the body top is movable between a lock position and an unlock position. A pair of leaf springs is fixed to the button, and extends through the body passageway. A nose extends from the body bottom, and is engageable with the leaf springs. A pin extends from each of the leaf springs. Each pin is engageable with a hole formed in the circuit breaker walls adjacent the switch tongue, wherein slidable movement of the button toward at least one of the lock position and unlock position engages the leaf spring with the nose to move each pin relative to the hole.

A general objective of the present invention is to provide a circuit breaker lock-out assembly which is engageable with holes formed in walls adjacent a circuit breaker tongue.

This objective is accomplished by providing leaf springs fixed to the button, wherein pins extending from each leaf spring are engageable with the holes formed in the walls adjacent the circuit breaker tongue.

Another objective of the present invention is to provide a circuit breaker lock-out assembly which is easily operated. This objective is accomplished by providing leaf springs fixed to a slidable button and arms which extend from the assembly body which are engageable with user fingers to allow single handed operation of the circuit breaker lock-out assembly.

The foregoing and other objectives and advantages of the invention will appear from the following description. In the description, reference is made to the accompanying drawings which form a part hereof, and in which there is shown by way of illustration a preferred embodiment of the invention.

DETAILED DESCRIPTION OF THE PREFERRED EMBODIMENTS

Figure 2:
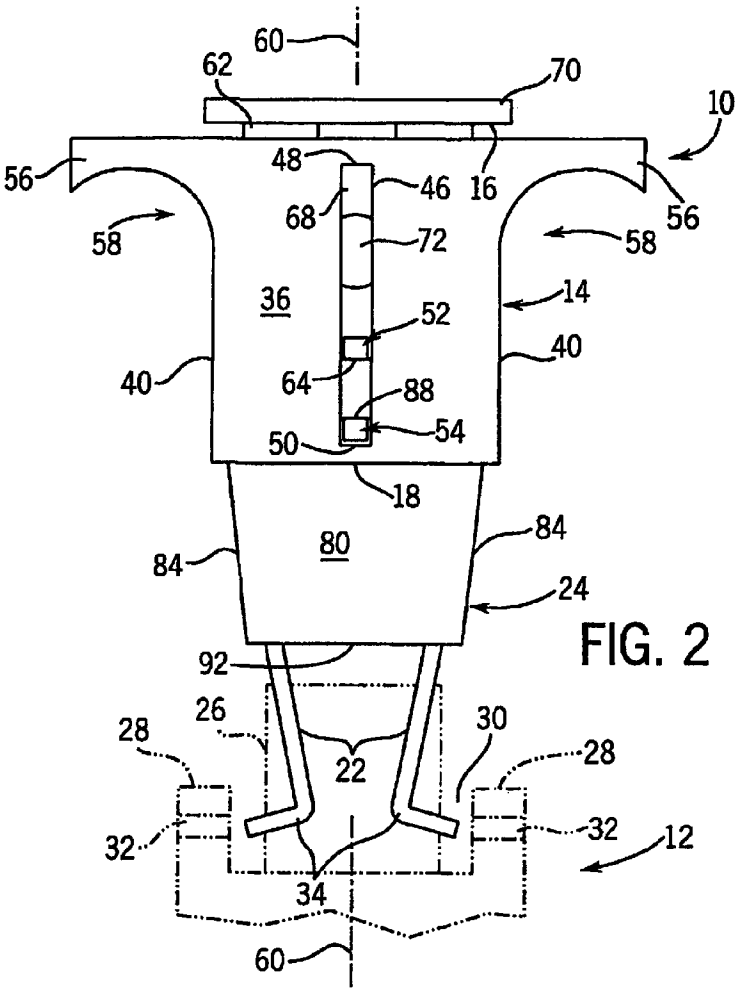
FIG. 2 is a front view of the lock-out assembly of FIG. 1 in an unlock position.
Figure 1:
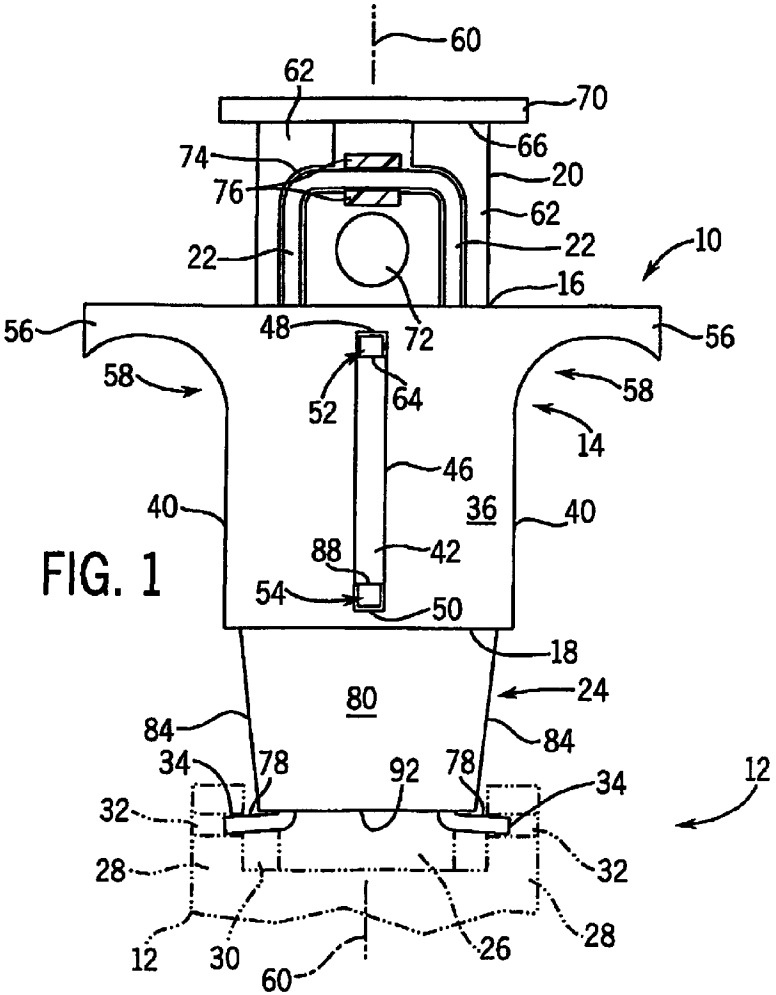
FIG. 1 is a front view of a circuit breaker lock-out assembly incorporating the present invention in an engaged position.
Figure 4:
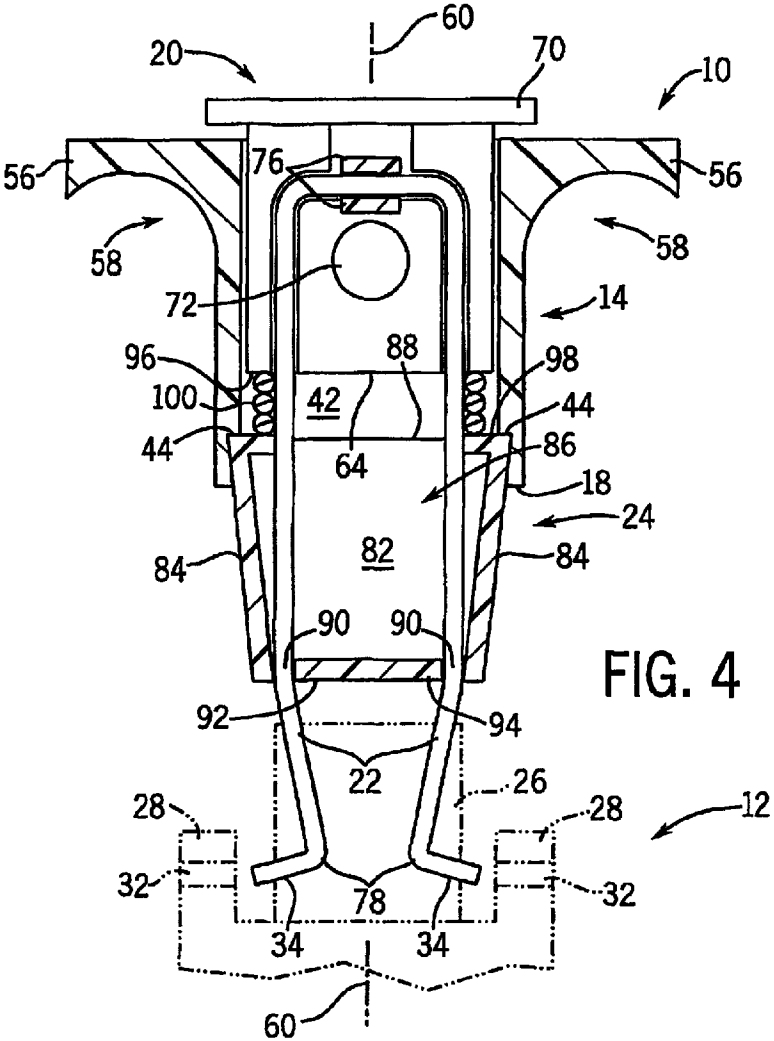
FIG. 4 is a sectional view of the lock-out assembly of FIG. 2.
Figure 3:
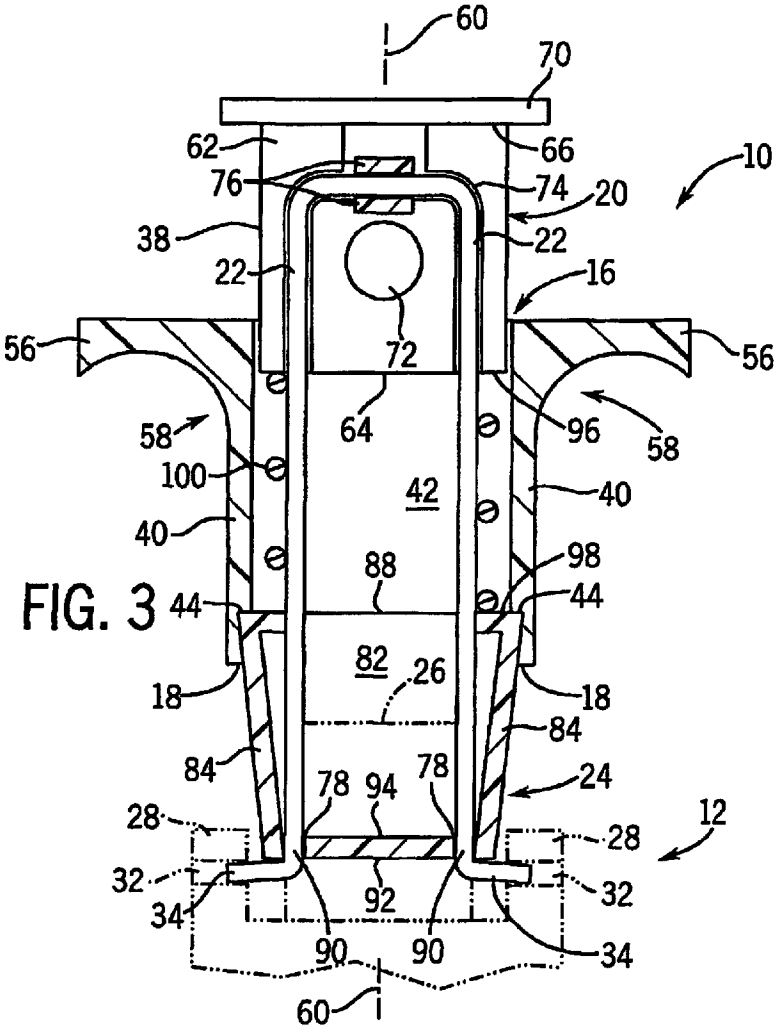
FIG. 3 is a sectional view of the lockout assembly of FIG. 1.

Referring to FIGS. 1–4, a circuit breaker lock-out assembly 10 is engageable with a circuit breaker 12 to lock-out the circuit breaker 12 and prevent undesired operation. The lock-out assembly 10 includes a hollow body 14 having an open top 16 and open bottom 18. A button 20 slidably inserted into the body top 16 retains a pair of opposing leaf springs 22 which extend through the body bottom 18. A nose 24 extending from the body bottom 18 engages the leaf springs 22 to locks the circuit breaker 12. Advantageously, the assembly 10 is operable by a user using one hand.

The circuit breaker 12 includes a switch tongue 26 movable between an "On" position and an "Off" position Walls 28 adjacent the switch tongue 26 between the "On" and "Off" positions define a switch tongue cavity 30. Opposing holes 32 in the adjacent walls 28 can receive pins 34 to prevent movement of the switch tongue 26. The circuit breakers can be any commercially available circuit breaker having a switch tongue movable between two or more positions, and having holes formed in opposing walls adjacent the switch tongue which can receive pins.

The circuit breaker lock-out assembly body 14 includes a front wall 36 and rear wall 38 joined by side walls 40. The walls 36, 38, 40 define a passageway 42 extending from the open body top 16 to the open body bottom 18. A step 44 formed in each side wall 40 can engage the nose 24 and prevent slidable movement of the nose 24 further into the passageway 42. A cleat slide opening 46 having an upper end 48 and a lower end 50 is formed in the body front wall 36, and receives cleats 52, 54 extending from the button 20 and nose 24. Preferably, a cleat slide opening (not shown) is also formed in the body rear wall 38, and also receives cleats (not shown) extending from the button 20 and nose 24.

Opposing arms 56 extend outwardly from each side wall 40 for engagement by user fingers. The arms 56 provide a grasping point for the user to enable single handed operation of the assembly 10. The exterior surface 58 of each side wall 40 below the arms 56 can be arcuately shaped to further accommodate the finger shape of the user.

The button 20 includes a base 62 having a bottom 64 slidably inserted into the passageway 42 through the open body top 16. A base top 66 and the base bottom 64 are joined by front and rear faces 68. A head 70 fixed to the base top 66 provides a thumb engagement surface for urging the button 20 into the body passageway 42 along an assembly axis 60 extending through the body passageway 42.

The button 20 slidably engages the body walls 36, 38, 40 for slidable movement in the passageway 42 along the assembly axis 60. The button 20 is slidable between a lock position (shown in FIGS. 1 and 3) and an unlock position (shown in FIGS. 2 and 4). In the lock position, the button 20 is only partially inserted into the body passageway 42. In the unlock position, the button 20 is inserted further into the body passageway 42 than in the lock position.

The button cleat 52 extends from the button base front face 68 into the body cleat slide opening 46. The button cleat 52 engages the cleat slide upper end 48 to prevent the base bottom 64 from sliding out of the passageway 42 through the body top 16. Preferably, a second button cleat (not shown) extends from the base rear face, and extends into a cleat slide opening farmed in the body rear wall 38.

An aperture 72 formed through the button base 62 from the front face 68 to the rear face is exposed when the button 20 is in the lock position. A pin member, such as a lock hasp, can be slipped through the aperture 72 to prevent the button 20 from being moved to the unlock position.

A cavity 74 formed in the base front face 68 receives the pair of leaf springs 22 which extend past the base bottom 64. The leaf springs 22 engage stops 76 extending substantially perpendicular to the axis 60. The stops 76 prevents the leaf springs 22 from slipping axially in the cavity 74. Although a cavity 74 having stops 76 to prevent axial movement of the leaf springs 22 is shown, other methods for fixing the leaf springs 22 to the button 20 can be used, such as fanning a groove in the base front face to receive the leaf springs, embedding a proximal end of each leaf spring in the body, and the like, without departing from the scope of the present invention.

The leaf springs 22 are fixed to the button 20, and extend through the body passageway 42 past the button base bottom 18. Preferably, the leaf springs 22 are formed from high tension spring wire joined at one end to form a U-shaped member, wherein each leaf spring 22 is a leg of a U-shaped member. A distal end 78 of each leaf spring 22 extends out of the nose 24 slidably mounted in the passageway 42.

A pin 34 is formed at each leaf spring distal end 78, and extends substantially perpendicular to the axis 60. The pins 34 engage the holes 32 formed in the switch tongue cavity walls 28 to prevent movement of the switch tongue 26 between the "On" and "Off" positions. In the embodiment shown in FIGS. 1–4, the leaf springs 22 are biased to move laterally inwardly away from the body side walls 40, and the pins 34 extend outwardly in opposite directions for engagement with the inwardly opening holes 32 formed in the switch tongue cavity walls 28.

The nose 24 channels the leaf spring 22 as the button 20 axially moves between the lock and unlock positions. The nose 24 extends out of the body passageway 42 through the body bottom 18, and includes a front wall 80 and rear wall 82 joined by side walls 84. The walls 80, 82,84 define a passageway 86 extending from an open nose top 88 to a pair of openings 90 in a nose bottom 92. A bottom wall 94 disposed between the openings 90 closes the nose bottom 92. Although a single passageway 86 extending through the nose 24 is shown, separate passageways leading to each opening 90 for each leaf spring 22 can be used without departing from the scope of the present invention.

The nose 24 slidably engages the body walls 80, 82, 84, and is dimensioned for slidable movement in the body passageway 42. Slidable movement of the nose 24 into the passageway 42 is limited by the body side wall steps 44 which can engage the nose top 88. Although slidably fixing the nose 24 in the body passageway 42 is preferred, the nose 24 can be rigidly fixed to the body 14, or formed as an integral part of the body 14 without departing from the scope of the present invention.

As in the button 20, the nose cleat 54 extends from the nose front wall 80, and is received in the body cleat slide opening 46. The nose cleat 54 engages the cleat slide lower end 50 to prevent the nose 24 from sliding out of the passageway 42 through the base bottom 18. Preferably, a second nose cleat (not shown) extends from the nose rear wall 82, and extends into the cleat slide opening formed in the body rear wall 38. Although cleats 52, 54 received in the cleat slide opening 46 are shown to limit axial movement of both the button 20 and nose 24 in the body passageway 42, other methods known in the art for limiting slidable movement, such as steps formed in the body 14, button 20, and nose 24, can be used without departing from the scope of the present invention.

The nose side walls 84 converge toward the axis 60, such that the open top 88 is laterally wider than the bottom 92. Bach bottom opening 90 is formed at the junction of one of the side walls 84 and the bottom wall 94. Each leaf spring 22 extends through one of the openings 90. As the leaf rigs 22 slidably move through the openings 90 to a lock position, the bottom wall 94 urges each leaf spring distal end 78, and thus the pins 34, outwardly to engage the switch tongue cavity holes 32.

Preferably, a helical spring 96 interposed between the button 20 and nose 24 biases the button 20 toward the lock position. The spring 96 has one end 98 engaging the nose top 88 and an opposing end 100 engaging the button bottom 64. Although a spring biasing the button toward the lock position is preferred, the lock-out assembly can be used with a biasing member biasing the button in the unlock position, and can be used without a biasing member biasing the button in any direction, without departing firm the scope of the invention.

In use, the user urges the button 20 toward the unlock position by depressing the button 20 which extends the leaf springs 22 through the nose bottom openings 90. The extended leaf springs 22 are biased inwardly, such ta the pins 34 can be slipped between the switch tongue cavity walls 28 and aligned with the inwardly opening holes 32. The user aligns the pins 34 with the holes 32, and then releases the button 20. When the button 20 is released, the helical spring 96 urges the button 20 to the lock position, and retracts the leaf springs 22 through the nose bottom openings 90. As the leaf springs 22 retract, the nose bottom wall 94 forces the leaf springs 22 outwardly, such that the pins 34 are forced into the holes 32. Once the pins 34 are received in the holes 32, the user can slip a lock hasp through the button aperture 72 to prevent the button 20 from being depressed to disengage the lock-out assembly 10 from the circuit breaker 12.

The process is reversed to disengage the lock-out assembly 10 from the circuit breaker 12. Advantageously, the lock-out assembly 10 can be engaged and disengaged from the circuit breaker 12 using one hand by imply depressing and releasing the button 20 using a thumb while two fingers are wrapped around the body arms 56 to hold the lock-out assembly 10.

Figure 5:
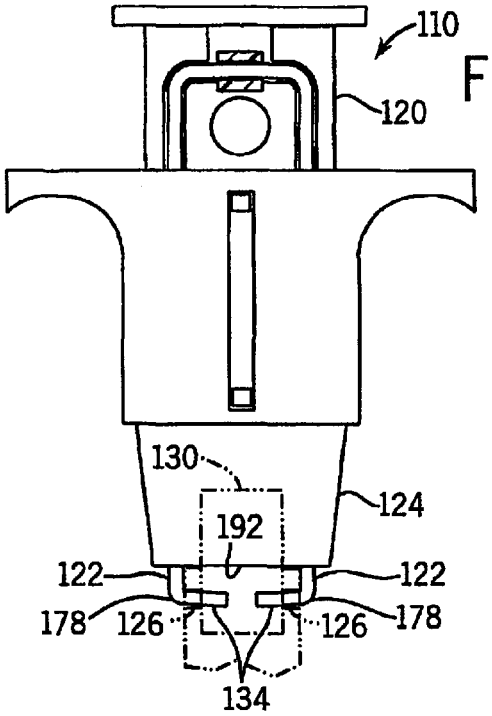
FIG. 5 is a front view of an alternate embodiment of a circuit breaker lock-out assembly in an engaged position.
Figure 7:
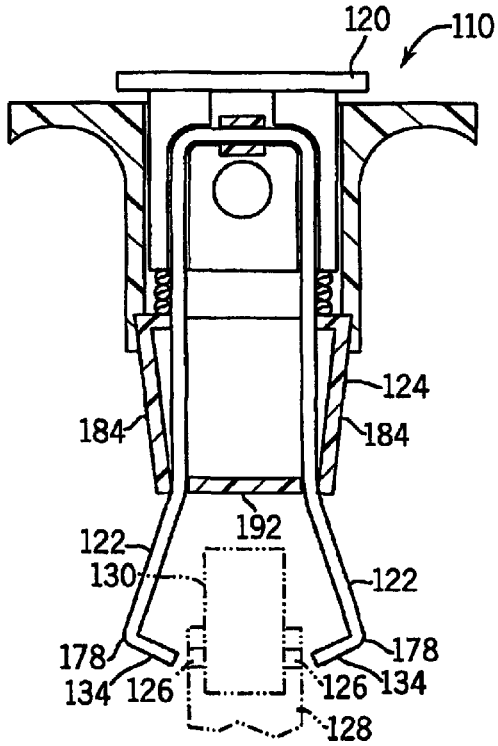
FIG. 7 is a sectional view of the lock-out assembly of FIG. 5 in an unlock position.
Figure 6:
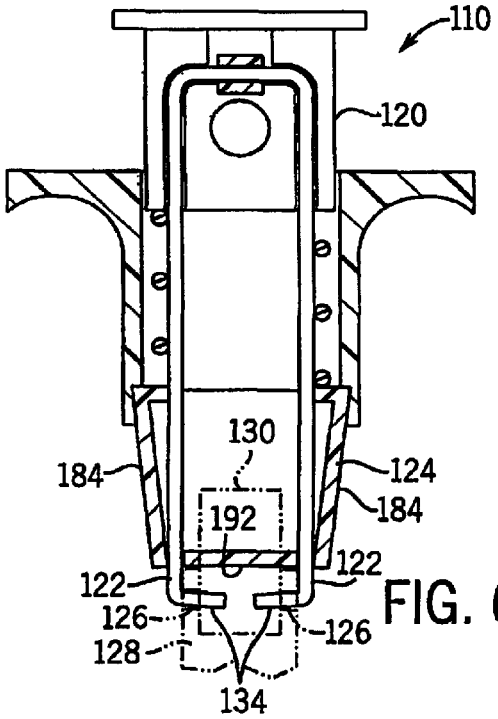
FIG. 6 is a sectional view of the lockout assembly of FIG. 5.

In another embodiment shown in FIGS. 5–7, a lock-out assembly 110 engages outwardly opening holes 126 formed in the walls 128 adjacent a circuit breaker switch tongue 130. In this embodiment, the leaf springs 122 are biased outwardly, and the pins 134 formed on the leaf spring distal ends 178 extend inwardly toward each other for engagement with the outwardly opening holes 126. The nose bottom 192 in the alternate embodiment assembly 110 is open, and the side walls 184 of the nose 124 force the leaf springs 122, and thus the pins 134, inwardly when the button 120 moves from the unlock position to the lock position.

While there have been shown and described what are at present considered the preferred embodiments of the invention, it will be obvious to those skilled in the art that various changes and modifications can be made therein without departing from the scope of the invention defined by the appended claims.

I claim:

1. A circuit breaker lock-out assembly for locking out a circuit breaker including a tongue moveable between a pair of walls having holes formed therein, said circuit breaker lock-out assembly comprising:

a body having a top and a bottom joined by walls, said walls defining a passageway extending from said top to said bottom;

a button having one end extending into said body passageway through said body top, and movable between a lock position and an unlock position;

a nose extending from said body bottom;

a pair of leaf springs fixed to said button, each of said leaf springs extending through said body passageway and being engageable with said nose; and a pin extending from each of said leaf springs, each pin being engageable with a hole formed in a wall adjacent the tongue, wherein slidable movement of said button toward at least one of said lock position and unlock position engages said leaf spring with said nose to move each pin relative to the hole formed in the wall.

2. The lock-out assembly of claim 1, in which said nose is formed as an integral part of said body.

3. The lock-out assembly of claim 1, in which a biasing member engaging said button biases said button toward said lock position.

4. The lock-out assembly of claim 1, in which arms extend outwardly from side walls of said body for engagement with fingers of a user.

5. The lock-out assembly of claim 1, in which at least one cleat extends outwardly from said button, and said one cleat engages a cleat slide formed in said body to prevent said button from disengaging from said body.

6. The lock-out assembly of claim 1, in which said leaf springs are biased inwardly toward each other, and said nose includes a wall which urges said leaf springs outwardly when said button moves from said unlock position to said lock position.

7. The lock-out assembly of claim 1, in which said leaf springs are biased outwardly away from each outer, and said nose includes walls which urge said leaf springs inwardly when said button moves from said unlock position toward said lock position.

8. The lock-out assembly of claim 1, in which an aperture formed in said button is exposed when said button is at least in said lock position, wherein a member slipped through said aperture prevents movement of said button from said lock position to said unlock position.

9. A circuit breaker lock-out assembly for locking out a circuit breaker including a tongue moveable between a pair of walls having inwardly opening holes formed therein, said circuit breaker lockout assembly comprising:

a body having a top and a bottom joined by walls, said walls defining a passageway extending from said top to said bottom;

a button having one end extending into said body passageway through said body top, and movable between a lock position and an unlock position;

a nose extending from said body bottom, and having nose sides which define at least one passageway extending from a nose top to a nose bottom;

a pair of openings formed in said nose bottom, and in communication with said nose passageway;

a pair of leaf springs fixed to said button, each of said leaf sprigs being biased outwardly away from each other, and extending through said body passageway and one of said openings in said nose bottom; and a pin extending from each of said leaf springs, each pin being engageable with an inwardly opening hole formed in the walls adjacent the tongue, wherein slidable movement of said button toward said lock position engages said leaf spring with said nose to move each pin relative to the hole formed in the wall.

10. A circuit breaker lock-out assembly for locking out a circuit breaker including a tongue moveable between a pair of walls having outwardly opening holes formed therein, said circuit breaker lock-out assembly comprising:

a body having a top and a bottom joined by walls, said walls defining a passageway extending from said top to said bottom;

a button having one end extending into said body passageway through said body top, and movable between a lock position and an unlock position;

a nose extending from said body bottom, and having nose sides which define at least one passageway extending from a nose top to a nose bottom;

a pair of leaf springs fixed to said button, each of said leaf springs being biased inwardly toward each other, extending through said body passageway and being engageable with said nose; and a pin extending from each of said leaf springs, each pin being engageable with an outwardly opening hole formed in one of the walls adjacent the tongue, wherein slidable movement of said button toward said lock position engages said leaf spring with said nose to move each pin relative to the hole formed in the wall.

* * * * *

UNITED STATES PATENT AND TRADEMARK OFFICE

CERTIFICATE OF CORRECTION

PATENT NO. : 6,844,512 B2
DATED : January 18, 2005
INVENTOR(S) : Benda

It is certified that error appears in the above-identified patent and that said Letters Patent is hereby corrected as shown below:

Title page,
Item [57], ABSTRACT,
Line 8, "the passageway" is changed to -- the body passageway --
Line 9, "ant" is changed to -- and --

Column 3,
Line 33, "farmed" is changed to -- formed --
Line 46, "fanning" is changed to -- forming --

Column 4,
Line 39, "Bach" is changed to -- forming --
Line 41, "rigs" is changed to -- springs --
Line 54, "firm" is changed to -- from --
Line 59, "such ta the" is changed to -- such that the --

Column 5,
Line 8, "imply" is changed to -- simply --

Column 6,
Line 31, "sprigs" is changed to -- springs --

Signed and Sealed this

Twenty-fourth Day of May, 2005

JON W. DUDAS
*Director of the United States Patent and Trademark Office*